US011457740B2

(12) United States Patent
Giery

(10) Patent No.: US 11,457,740 B2
(45) Date of Patent: Oct. 4, 2022

(54) LOCKING DEVICE AND STABILIZER FOR A STABILIZING TABLE

(71) Applicant: Rockless Table LLC, El Segundo, CA (US)

(72) Inventor: Ronald Giery, Manhattan Beach, CA (US)

( * ) Notice: Subject to any disclaimer, the term of this patent is extended or adjusted under 35 U.S.C. 154(b) by 10 days.

(21) Appl. No.: 16/984,669

(22) Filed: Aug. 4, 2020

(65) Prior Publication Data

US 2021/0030153 A1 Feb. 4, 2021

Related U.S. Application Data

(60) Provisional application No. 62/882,570, filed on Aug. 4, 2019.

(51) Int. Cl.

| | |
|---|---|
| ***A47B 97/00*** | (2006.01) |
| ***A47C 7/00*** | (2006.01) |
| ***A47B 9/20*** | (2006.01) |

(52) U.S. Cl.

CPC ..... *A47B 97/00* (2013.01); *A47B 9/20* (2013.01); *A47C 7/008* (2013.01); *A47B 2097/008* (2013.01)

(58) Field of Classification Search

CPC ..... A47B 97/00; A47B 9/20; A47B 2097/008; A47B 87/002; A47B 3/002; A47B 13/02; A47B 13/021; A47B 13/003; A47B 91/16; A47C 7/008; Y10T 403/46; Y10T 403/4602; Y10T 403/4608; Y10T 403/4631; F16B 2/18; F16B 2/185; F16C 11/10; F16C 11/103

USPC ..... 108/147.21, 155, 153.1, 144.11, 147.19, 108/147.2, 150; 248/188.1, 188.6, 357

See application file for complete search history.

(56) References Cited

U.S. PATENT DOCUMENTS

| | | | | |
|---|---|---|---|---|
| 1,800,456 | A | 4/1931 | Lawrence | |
| 2,787,087 | A | 4/1957 | Whitman | |
| 2,793,468 | A | 5/1957 | Alfred | |
| 2,865,696 | A | 12/1958 | Alfred | |
| 3,263,389 | A | 8/1966 | Heirich | |
| 3,278,147 | A | 10/1966 | Clark | |
| 4,053,129 | A | 10/1977 | Graff | |
| 4,076,202 | A * | 2/1978 | McConnell | A47B 91/12 248/188.2 |

(Continued)

*Primary Examiner* — Janet M Wilkens

(74) *Attorney, Agent, or Firm* — Eandi Fitzpatrick LLP

(57) ABSTRACT

A table with a stabilizing system is disclosed. The table has a primary shaft having a bottom portion, a lower portion, and an upper portion, wherein the primary shaft has a cut-out at a bottom portion, a locking hole at a lower portion, and a stabilization mounting hole at the upper portion, a secondary shaft inserted into the primary shaft and when inserted, movably affixed to the primary shaft, wherein the secondary shaft has a bottom portion, a lower portion, and an upper portion, and wherein the secondary shaft a locking hole at the lower portion, and a stabilization mounting hole at the upper portion, a pivot positioned through the primary shaft stabilization mounting hole and the secondary shaft mounting hole to movably affix the secondary shaft to the primary shaft about a single point of movement, a lock positioned through the primary shaft locking hole and the secondary shaft locking hole, wherein the lock fastens the secondary shaft to the primary shaft.

9 Claims, 20 Drawing Sheets

(56) References Cited

U.S. PATENT DOCUMENTS

| | | | | |
|---|---|---|---|---|
| 4,077,419 | A * | 3/1978 | Lux | E04F 10/0633 160/68 |
| 4,238,097 | A * | 12/1980 | Clausen | A47B 19/06 248/188.7 |
| 4,456,095 | A | 6/1984 | Hodson | |
| 4,867,610 | A | 9/1989 | Diffrient | |
| 5,370,063 | A | 12/1994 | Childers | |
| 5,513,825 | A | 5/1996 | Gutgsell | |
| 5,685,510 | A | 11/1997 | Frankish | |
| 5,690,303 | A | 11/1997 | Winters | |
| 6,009,815 | A | 1/2000 | Hartman | |
| 6,209,465 | B1 | 4/2001 | Brooks | |
| 6,360,675 | B1 | 3/2002 | Jones | |
| 6,705,239 | B2 | 3/2004 | Doyle | |
| 6,776,106 | B2 | 5/2004 | Lin | |
| 7,204,193 | B2 | 4/2007 | Scherrer et al. | |
| 7,610,865 | B2 | 11/2009 | Korb | |
| 8,162,273 | B2 | 4/2012 | Jones | |
| 8,596,598 | B2 | 12/2013 | Lai | |
| 8,870,134 | B2 | 10/2014 | Catoni et al. | |
| 9,414,676 | B1 | 8/2016 | Raffi | |
| 9,635,939 | B2 * | 5/2017 | Taylor | A47B 91/16 |
| 10,342,328 | B2 | 4/2019 | Raffi | |
| 10,463,152 | B1 * | 11/2019 | Day | A47B 27/02 |
| 2002/0096617 | A1 | 7/2002 | Marcotte et al. | |
| 2003/0051642 | A1 * | 3/2003 | Tseng | A47B 3/14 108/129 |
| 2003/0230681 | A1 | 12/2003 | Gwynneth | |
| 2005/0057012 | A1 * | 3/2005 | Boyle | B62K 3/16 280/87.05 |
| 2005/0151037 | A1 | 7/2005 | Oxley | |
| 2007/0252053 | A1 | 11/2007 | Brooke | |
| 2007/0272638 | A1 | 11/2007 | Berg | |
| 2008/0178779 | A1 | 7/2008 | Agee | |
| 2010/0071599 | A1 | 3/2010 | Mcentire | |
| 2012/0085873 | A1 | 4/2012 | Brooke | |
| 2013/0036950 | A1 | 2/2013 | Heyring et al. | |
| 2014/0014007 | A1 * | 1/2014 | Sinegal | A47B 37/04 108/147.21 |
| 2016/0081468 | A1 | 3/2016 | Molteni | |
| 2016/0178114 | A1 | 6/2016 | Hoyle | |
| 2016/0184164 | A1 * | 6/2016 | Browning | A61G 7/1044 482/115 |
| 2017/0135466 | A1 | 5/2017 | Randlov | |
| 2017/0258224 | A1 * | 9/2017 | Reynolds | A47B 47/042 |
| 2022/0071384 | A1 * | 3/2022 | Giery | A47B 3/0818 |

* cited by examiner

LOCKING DEVICE AND STABILIZER FOR A STABILIZING TABLE

CROSS-REFERENCE TO RELATED APPLICATIONS

This application claims the benefit of U.S. Provisional Patent Application Ser. No. 62/882,570 filed Aug. 4, 2019 entitled Locking Device and Stabilizer for Stabilizing a Table, the entire contents of which are incorporated by reference herein for all purposes.

FIELD OF THE INVENTION

The present invention relates generally to tables and chairs. More particularly, the present invention relates to a locking mechanism and a stabilization mechanism for a table or chair configured to keep the table or chair stable and prevent from rocking and tipping over if weight is applied to the edge of the table.

BACKGROUND

Tabletops, especially those associated with tables used in restaurants and other commercial outlets, are ideally stable such that articles placed on a tabletop thereof remain steady. However, based on a myriad of factors such as uneven surfaces, ground warping, and material warping, tables and chairs tend to rock back and forth, which is very disruptive for those seated thereabout. Solutions including the placement of folded paper under one leg of the table, which is simply ineffective and inefficient.

An exemplary solution is described in U.S. Pat. No. 9,414,676 to Eddie Rafi, entitled "Table and chair with self-stabilizing system" which discloses an integral system for stabilizing a table on an uneven surface. The table comprises a tabletop supported by a first end of a primary shaft, a second end of said primary shaft having a first pair of legs extending therefrom, a secondary shaft positioned within, and movably joined at a first end to, said primary shaft, a second end of said secondary shaft having a second pair of legs extending therefrom, wherein said secondary shaft may move in a side-to-side, rocking manner relative to the primary shaft thereby stabilizing the table.

Another exemplary solution is described in U.S. Pat. No. 10,342,328B2 to Eddie Rafi that describes an integral system for stabilizing a long table on an uneven surface. One version includes two spaced supports with each of the supports comprising a vertical member. One horizontal platform attaches to an upper portion of one of the supports and an underside of the tabletop and a second horizontal platform affixed to a post and attached to the underside of the tabletop. The post is insertable into the vertical member of the other support and movably joined at a first end thereto such that the post may move side-to-side, in a rocking manner relative to the vertical member stabilizing the table.

There is a need for a system to further stabilize tables and chairs that utilize non-rocking technology that are operable with tables of many different shapes and sizes, thereby preventing them from rocking and tipping over if weight is applied to the edges.

SUMMARY OF THE INVENTION

The present invention generally relates to tables and chairs. Further, the present invention discloses a locking mechanism and a stabilization system for a table or chair configured to keep the table or chair stable and prevent rocking and tipping over if weight is applied to an edge of the table.

In embodiments, a table with a stabilizing system comprises a primary shaft having a bottom portion, a lower portion, and an upper portion, wherein the primary shaft has a cut-out at a bottom portion, a locking hole at a lower portion, and a stabilization mounting hole at the upper portion; a secondary shaft inserted into the primary shaft and when inserted, movably affixed to the primary shaft, wherein the secondary shaft has a bottom portion, a lower portion, and an upper portion, and wherein the secondary shaft a locking hole at a lower portion, and a stabilization mounting hole at the upper portion; a pivot positioned through the primary shaft stabilization mounting hole and the secondary shaft mounting hole to movably affix the secondary shaft to the primary shaft about a single point of movement; a lock positioned through the primary shaft locking hole and the secondary shaft locking hole, wherein the lock fastens the secondary shaft to the primary shaft.

A locking system for a table with a stabilizing system comprising a primary shaft, a secondary shaft inserted into the primary shaft and when inserted, is movably affixed to the primary shaft is provided. The locking system comprises a lock positioned through a primary shaft locking hole and a secondary shaft locking hole, wherein the lock fastens the secondary shaft to the primary shaft; wherein the primary shaft has a bottom portion, a lower portion, and an upper portion, and wherein the locking hole is positioned at a lower portion; wherein the secondary shaft has a bottom portion, a lower portion, and an upper portion, and wherein the secondary shaft locking hole is positioned at a lower portion.

In embodiments, a stabilization system for a table comprising a primary shaft, a secondary shaft inserted into the primary shaft and when inserted, is movably affixed to the primary shaft is provided. The stabilization system comprises a pivot positioned through the primary shaft stabilization mounting hole and the secondary shaft mounting hole to movably affix the secondary shaft to the primary shaft about a single point of movement; wherein the primary shaft has a bottom portion, a lower portion, and an upper portion, and wherein the locking hole is positioned at a lower portion; wherein the secondary shaft has a bottom portion, a lower portion, and an upper portion, and wherein the secondary shaft locking hole is positioned at a lower portion.

In operation, the stabilization system is configured to provide self-stabilizing support for the table on uneven surfaces by the movement of the secondary shaft and to prevent wobble. In one embodiment, the stabilization system comprises one or more shims securely mounted on the secondary shaft for providing self-stabilizing support for the table on uneven surfaces and to prevent wobble.

In one embodiment, the pair of legs are perpendicularly affixed to the bottom portion of the secondary shaft. In one embodiment, the pair of legs are extending from the bottom portion of the secondary shaft. In one embodiment, the primary shaft further comprises a pair of legs. The pair of legs are extending from the bottom portion of the primary shaft. In one embodiment, the table with the stabilizing system further configured to use with an additional fixed primary shaft having a pair of legs for supporting a long table. The pair of legs are steadily and perpendicularly secured to the bottom portion of the additional fixed primary shaft. In one embodiment, the table with the stabilizing system further comprises one or more support braces. The one or more support braces are securely affixed to the primary shaft for supporting the tabletop.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

Figure 1:
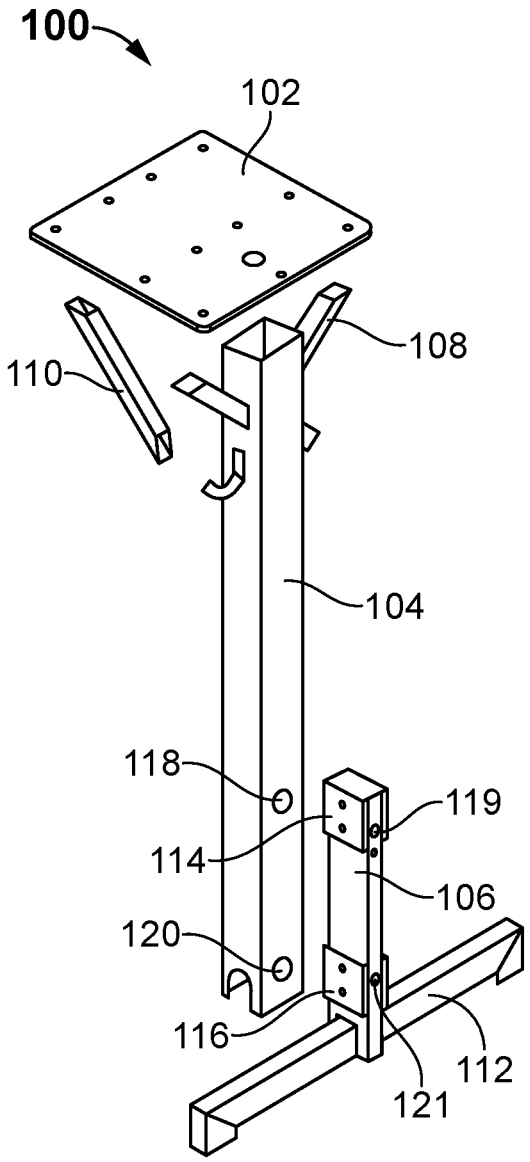
FIG. 1 illustrates an exploded view of a table having a primary shaft and a secondary shaft in one embodiment of the present invention.

The present invention is best understood by reference to the detailed figures and description set forth herein.

Embodiments of the system are discussed below with reference to the examples. However, those skilled in the art will readily appreciate that the detailed description given herein with respect to these examples is for explanatory purposes as the system extends beyond these limited embodiments. For example, it should be appreciated that those skilled in the art will, in light of the teachings of the present system, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the system that are too numerous to be listed but that all fit within the scope of the system. Also, singular words should be read as plural and vice versa and masculine as feminine and vice versa, where appropriate, and alternative embodiments do not necessarily imply that the two are mutually exclusive.

It is to be further understood that the present system is not limited to the particular methodology, compounds, materials, manufacturing techniques, uses, and applications, described herein, as these may vary. It is also to be understood that the terminology used herein is used for the purpose of describing particular embodiments only and is not intended to limit the scope of the present system. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this system belongs. Preferred methods, techniques, devices, and materials are described, although any methods, techniques, devices, or materials similar or equivalent to those described herein may be used in the practice or testing of the present system.

It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 2:
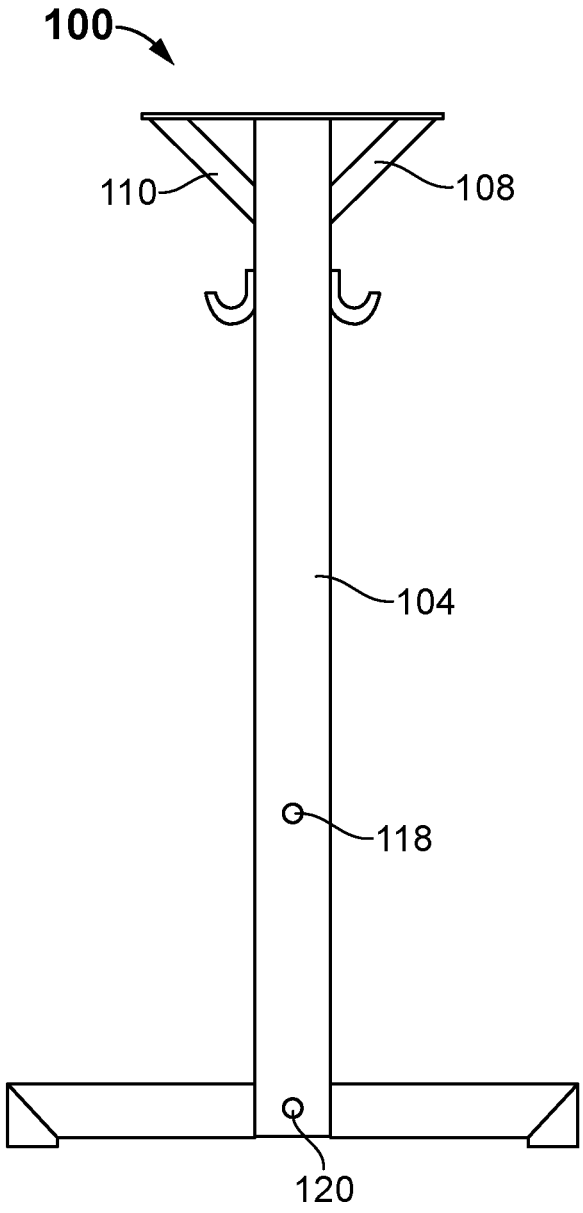
FIG. 2 illustrates a side view of the table with a stabilizing system in one embodiment of the present invention.

Referring now to FIGS. 1 and 2, a table 100 for which the use of a stabilizing system is disclosed. FIG. 1 provides an exploded view in which the secondary shaft can be seen, and FIG. 2 provides a side view of the table in fact in which the secondary shaft resides inside of the primary shaft 104. In one embodiment, the table 100 is provides self-stabilizing support on uneven surfaces and comprises a primary shaft 104 and a secondary shaft 106. The primary shaft 104 has a cut-out at a bottom portion and one or more support braces (108 and 110) at a top portion. The primary shaft 104 is configured to securely support a tabletop 102, though in other embodiments a secondary shaft may support a tabletop. In one embodiment, the support braces (108 and 110) are configured to provide additional support for the tabletop 102. The primary shaft comprises stabilization mounting hole 118 at an upper portion which is dimensioned for the insertion of a pivot, in one embodiment, a sex bolt, a locking hole 120 at a lower portion dimensioned for the insertion of a locking assembly (also referred to herein as "braking system"). The secondary shaft 106 comprises a pair of legs 112 at the bottom portion which are perpendicularly secured to the secondary shaft 106. In operation, the secondary shaft 106 is configured to securely insert into the primary shaft 104 and is movably affix to the primary shaft 104 about a single point of movement using a sex bolt assembly 1202 (shown in FIG. 16), thereby providing stabilization to the primary shaft 104 and the secondary shaft 106 when the table 100 is on even or flat surfaces when a user using the locking assembly (shown in FIGS. 9-12). The secondary shaft 106 comprises its own stabilization mounting hole 119 at an upper portion which is dimensioned for the insertion of a sex bolt, and its own locking hole 121 at a lower portion dimensioned for the insertion of a locking assembly.

In one embodiment, the stabilization system is configured to provide self-stabilizing support for the table 100 on uneven surfaces by the movement of the secondary shaft 106. In one embodiment, the stabilization system comprises one or more shims (114 and 116), which are securely mounted on the secondary shaft 106 for providing self-stabilizing support for the table 100 on the uneven surfaces. In operation, when the locking assembly is tightened by a user, the shims 114 and 116 provide a slight cushioning to protect the parts and also provide a barrier against wobble. In this regard, the shims may be made of rubber or a material having optimized hardness.

Figure 3:
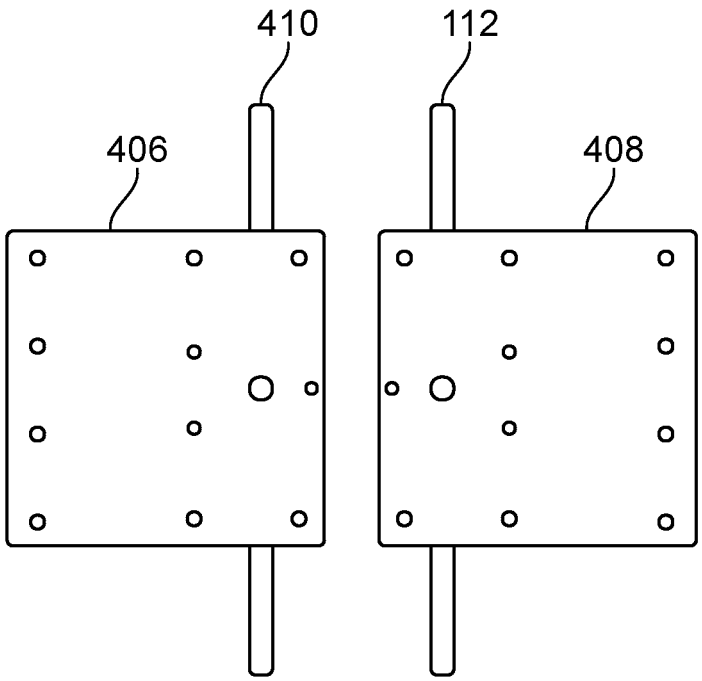
FIG. 3 illustrates a top view of the table used with an additional fixed primary shaft having a pair of legs for supporting a long table in another embodiment of the present invention.
Figure 4:
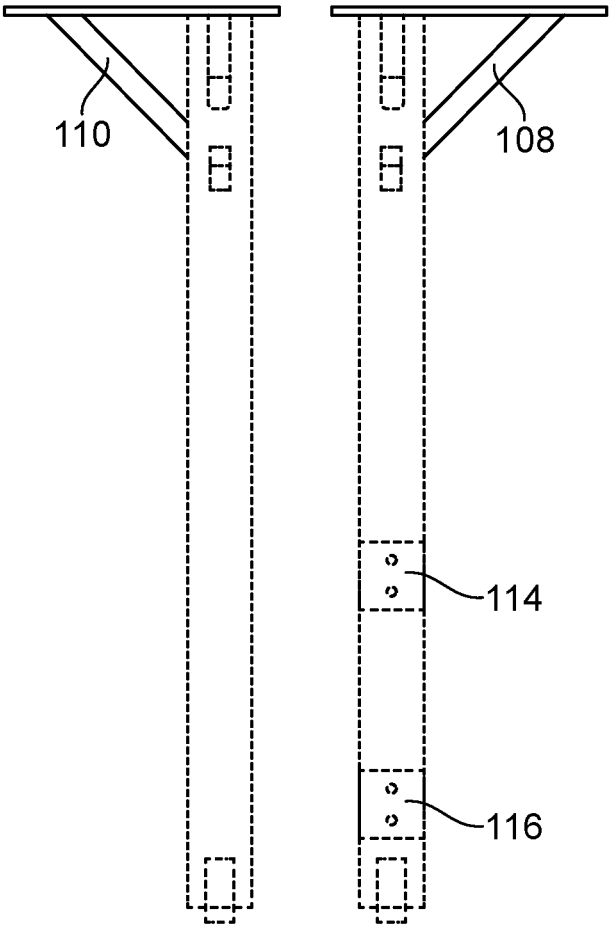
FIG. 4 illustrates a side view of the table used with an additional fixed primary shaft having a pair of legs for supporting a long table in another embodiment of the present invention.
Figure 5:
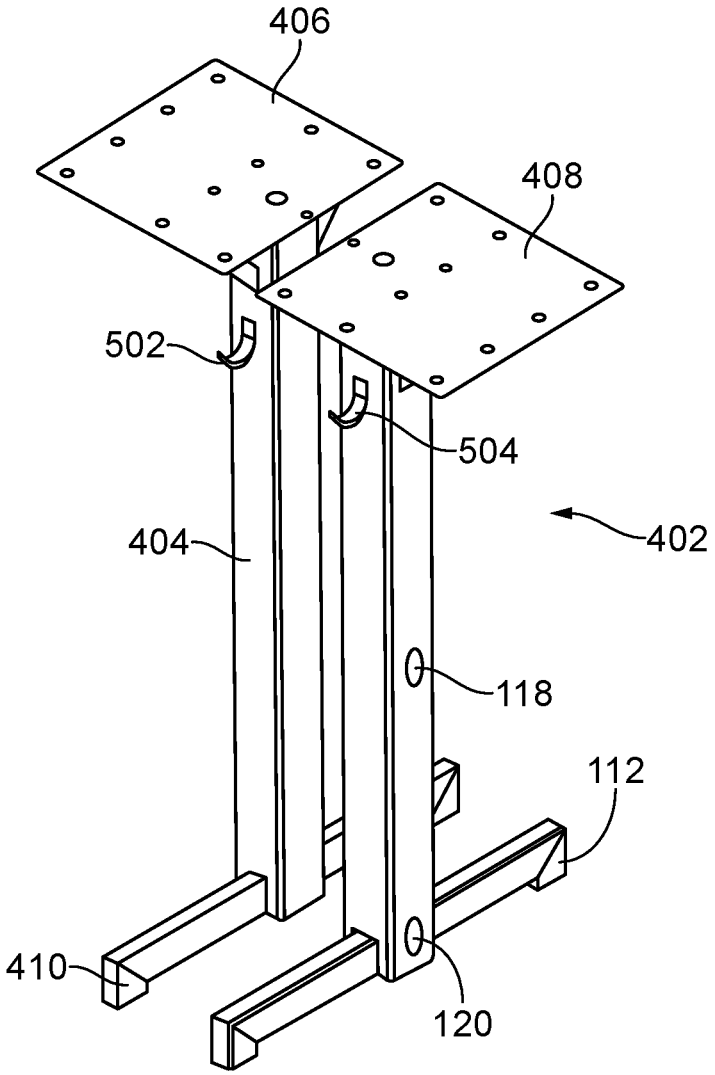
FIG. 5 illustrates a perspective view of the table used with an additional fixed primary shaft having a pair of legs for supporting a long table in another embodiment of the present invention.

Referring now to FIGS. 3, 4 and 5, a table of a different type is shown. This table is used with an additional fixed shaft 404 having a pair of legs 410 for supporting a long table in another embodiment is disclosed. In one embodiment, the table 100 is configured to use with the additional fixed primary shaft 404 for supporting a long table. In one embodiment, the additional fixed primary shaft 404 is a normal table shaft with the pair of legs 410. In one embodiment, the pair of legs 410 are steadily and perpendicularly secured to the bottom portion of the additional fixed primary shaft 404. In one embodiment, the additional fixed primary shaft 404 further comprises one or more support braces 110 for securely supporting the tabletop 406. In one embodiment, the secondary shaft 106 of the table 100 is provided with the shims (114 and 116) for providing self-stabilizing support for the table 100 on the uneven surfaces. In one embodiment, the primary shaft 402 is configured to support the tabletop 408. In one embodiment, the locking assembly (shown in FIGS. 9-12) is securely affixed through the primary shaft 402 and through the secondary shaft 106 via the stabilization mounting holes 118 using one or more bushings (1302 and 1304 of FIG. 13). Each leg is further provided with hooks 602 and 604 to hand items such as a purse or bag.

Figure 6:
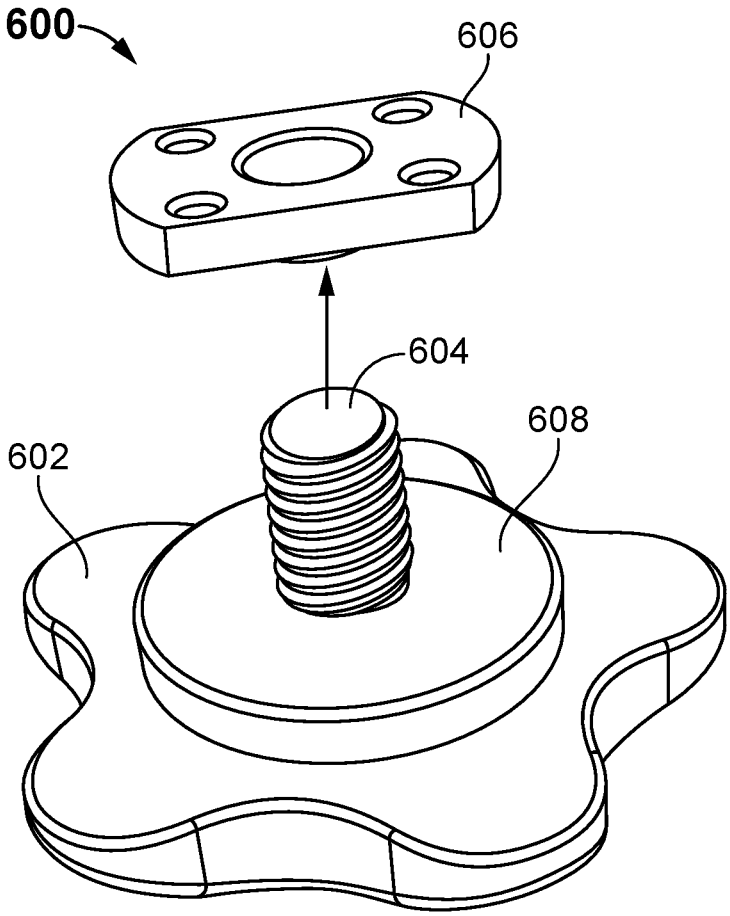
FIG. 6 illustrates a bottom perspective view of a brake knob with a threaded weld insert or a bushing in one embodiment of the present invention.

Referring now to FIG. 6, In one embodiment, the table 100 further comprises a braking system 600 which is inserted into the and through holes 120 and 121 positioned at the lower portion of the table 100. The braking system 600 allows a measurable and consistent application of force to the secondary shaft assembly causing an increase in the coefficient of friction between the primary and secondary shafts (104 and 106), respectively to hold, or lock, the secondary shaft 106 in place, stabilizing the table base and in turn the top of tabletop. In this way, it helps to prevent the shafts from separating if weight is applied to the edge of the tabletop. In one embodiment, the braking system 600 is configured to enable the user for tightening the primary shaft 104 and the secondary shaft 106 at the bottom when the table 100 is self-stabilized on the uneven surfaces using a brake knob 602 having a threaded shaft 604 and maintaining the bottom of the primary shaft 104 and secondary shaft 106 to control the movement or rotation. In one embodiment, the brake knob 602 is threadedly secured to the lower portion of the primary shaft 104 via aperture 120, and the secondary shaft via aperture 121.

Figure 7:
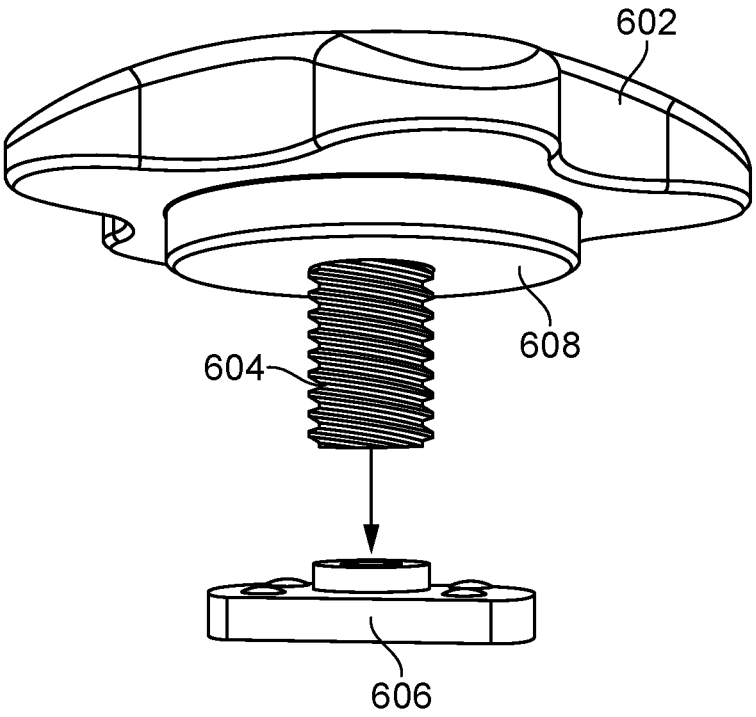
FIG. 7 illustrates a top perspective view of the brake knob with the threaded weld insert or bushing in one embodiment of the present invention.
Figure 8:
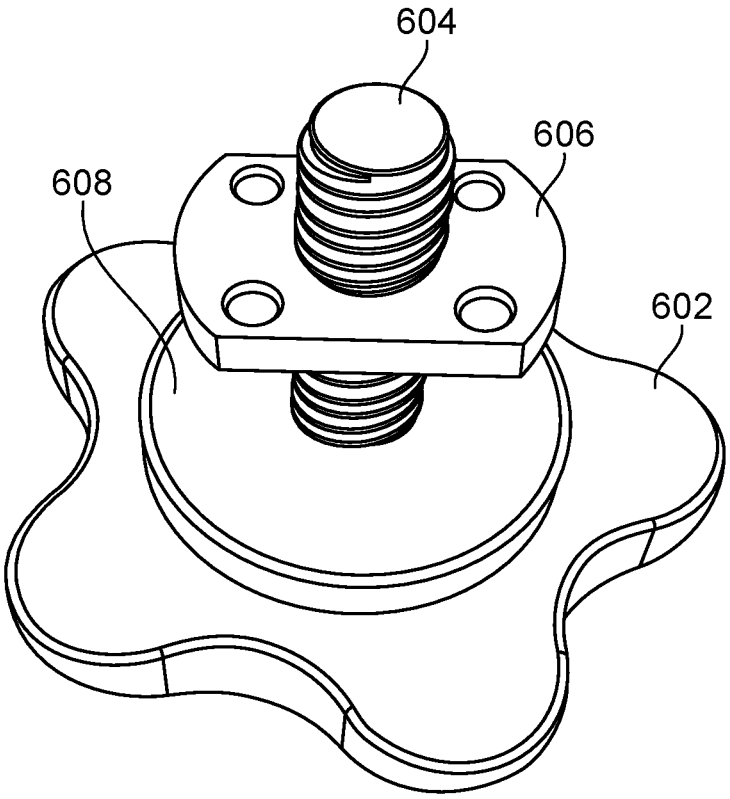
FIG. 8 illustrates a bottom perspective view of the brake knob threaded to the threaded weld insert or a bushing in one embodiment of the present invention.
Figure 17:
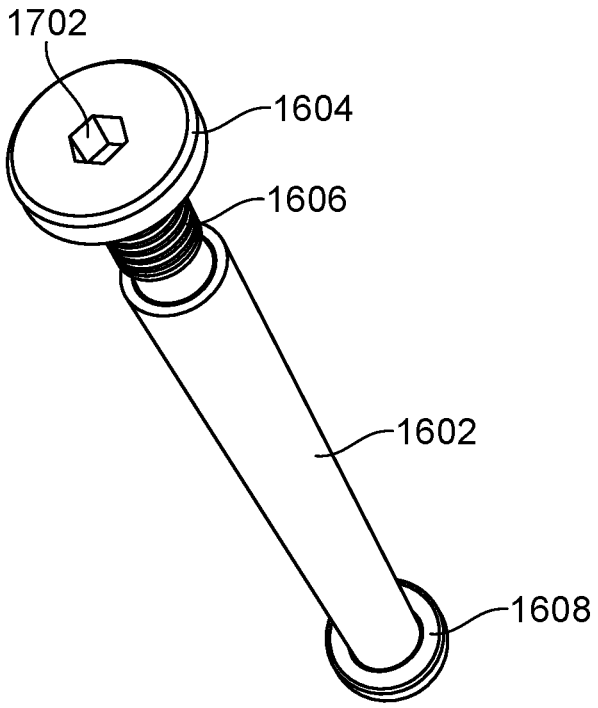
FIG. 17 illustrates a top perspective view of the sex bolt assembly having hex divot in one embodiment of the present invention.

Referring to FIGS. 7 and 8, in one embodiment, the locking assembly 600 is securely affixed to the primary shaft 104 and the secondary shaft 106 via stabilization mounting holes 120 using one or more bushings (1302 and 1304) (shown in FIG. 17). In one embodiment, the locking assembly 600 is configured to enable the user to safely lock the primary shaft 104 and the secondary shaft 106 when the table 100 is on the even or flat surface. The brake knob 602 with a threaded weld insert or bushing 606 is shown, and allows the user, when assembled, to one embodiment, the user could tighten the primary shaft 104 and the secondary shaft 106 at the bottom when the table 100 is self-stabilized on the uneven surfaces using the brake knob 602 and maintaining the bottom of the primary shaft 104 and secondary shaft 106 to control the movement or rotation of the shafts. In one embodiment, the brake knob 602 is threadedly secured to the bottom of the primary shaft 104 via the brake aperture 120 and 121 (shown in FIG. 2). The brake 602 could allow the user to twist for tightening the brake when the table 100 self-stabilized on the uneven surfaces and make sure it doesn't tip when the pressure applied to the outside edges of the tabletop. In one embodiment, the brake knob 602 comprises a threaded shaft 604, which is extended from a strut 608. The strut mates with the primary and secondary shafts (104 and 106) when it is tightened to provide pressure. In one embodiment, the threaded weld inserts or bushing 606 is welded to the inside of the primary tube 104. The brake knob 602 is threaded into the insert and applying force to the secondary shaft/tube or leg assemble 106. In one embodiment, the brake knob 602 is at least any one of, but not limited to a clamping knob, a threaded knob, a star knob or a hand knob having a threaded stud or a threaded through-hole and a knob shape, and a quick-release latch and skewer shown in FIG. 11.

Figure 9:
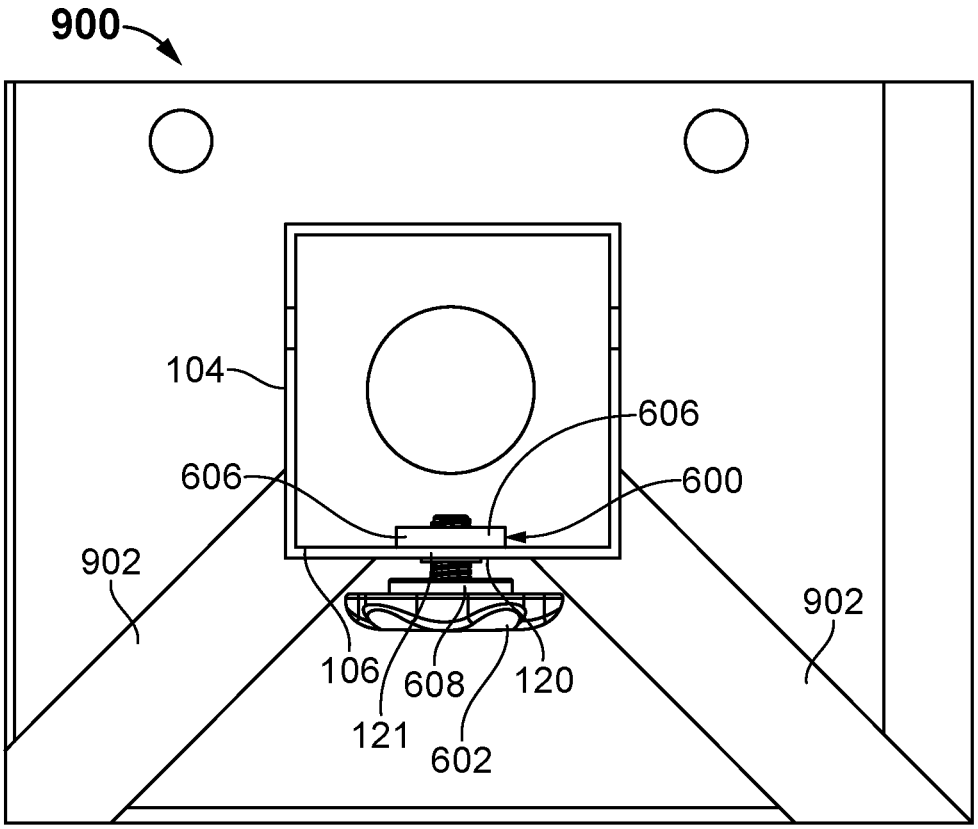
FIG. 9 illustrates a bottom view of a braking system used to hold or lock the secondary shaft in place in one embodiment of the present invention.

Referring now to FIG. 9, a bottom view of the brake assembly 600 is shown inserted into the table shafts 104 and 106 is shown generally at 900. As can be seen, the brake knob 602, threaded shaft 604, and strut 608 work together to mates with the primary and secondary shafts (104 and 106) when it is tightened to provide pressure. In one embodiment, the threaded weld inserts or bushing 606 is welded to the inside of the primary tube 104. The brake knob 602 is threaded into the insert and applying force to the secondary shaft/tube or leg assemble 106.

The brake knob 602 allows for a convenient and easy to use a handle for applying a consistent force by hand and remain applying the force until the force is required to be released. The threaded weld inserts 606 affords a means to securely attach a female thread to the primary tube 106. The threaded weld inserts 606 also allows for the correct number of threads to come in contact with the male, knob threads. This ratio gives a factor of safety for the application of the clamping force.

In operation, braking system 600 allows a measurable and consistent application of force to the secondary shaft assembly causing an increase in the coefficient of friction between the primary and secondary shafts (104 and 106) to hold or lock the secondary shaft 106 in place and stabilize the table base. The braking system 600 is configured to enable the user to twist the brake knob 602 for tightening the primary shaft 104 and the secondary shaft 106 at the bottom when the table 100 is self-stabilized on the uneven surfaces using and maintaining the bottom of the primary shaft 104 and secondary shaft 106 to control the movement or rotation. In one embodiment, the brake knob 602 is securely threaded to a threaded weld insert or bushing 606. In one embodiment, the threaded weld inserts or bushing 606 is made of, but not limited to, a softer material for preventing damages to the primary shaft 104 and the secondary shaft 106. In another embodiment, a pair of legs 902 are extended from the bottom of the primary shaft 104.

Figure 10:
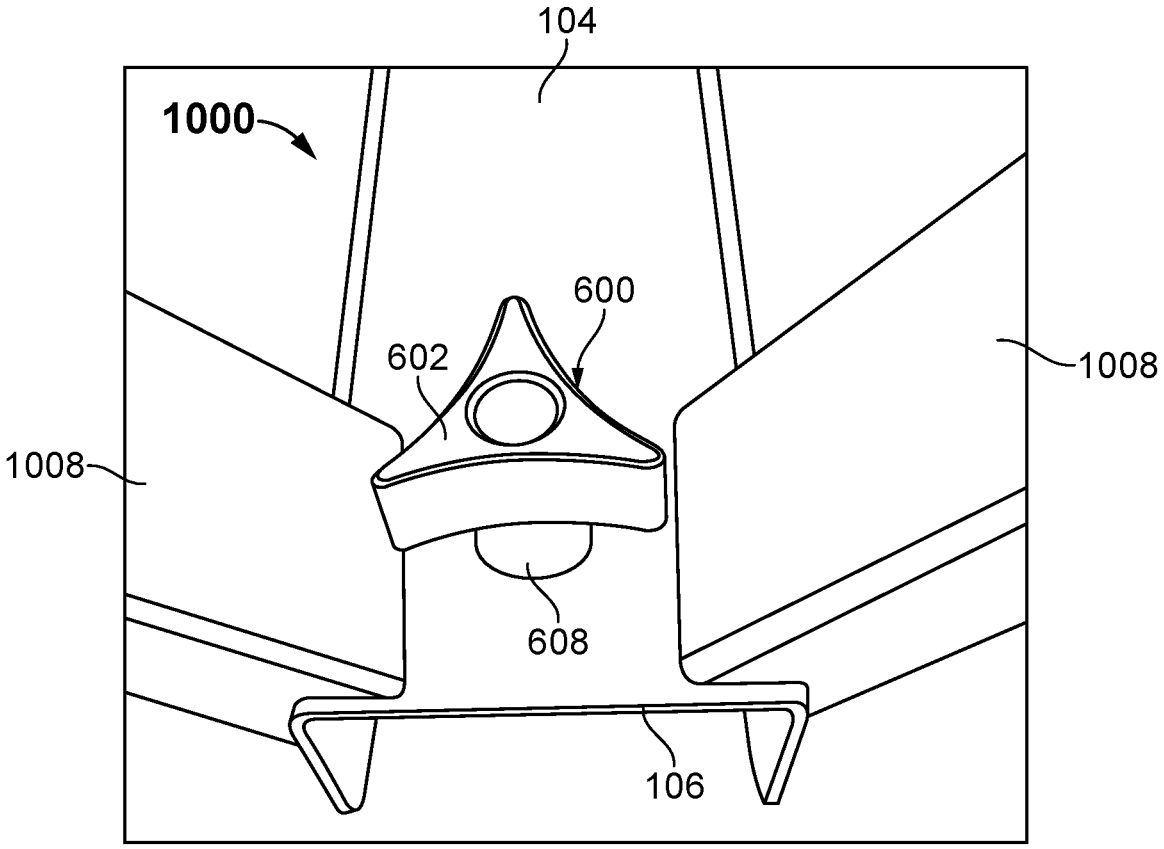
FIG. 10 illustrates a bottom perspective view of the braking system used to hold or lock the secondary shaft in place in another embodiment of the present invention.

Referring to FIG. 10, a bottom perspective view 1000 of the braking system 600 used to hold or lock the secondary shaft 106 in place in another embodiment is disclosed. In an exemplary embodiment, the user could tighten the primary shaft 104 and the secondary shaft 106 at the bottom 1006 when the table 100 is self-stabilized using the brake knob 602 and maintaining the bottom 1006 of the primary shaft 104 and secondary shaft 106 to control the movement or rotation. In one embodiment, the brake knob 602 could be, but not limited to, a triangular knob. In one embodiment, the brake knob 602 comprises a threaded shaft, which is extended from a strut. In one embodiment, the brake knob 1004 is threadedly secured to the bottom of the primary shaft 104 via the brake aperture 120 (shown in FIG. 2). In one embodiment, the brake knob 1004 is threadedly secured to the bottom 1006 of the primary shaft 104 via the brake aperture 120 and secondary shaft via aperture 121 (shown in FIG. 2). The brake knob 602 allows the user to twist for tightening the brake when the table 100 self-stabilized on the uneven surfaces and make sure it doesn't tip when the pressure applied to the outside edges of the brake knob 1004. The brake knob 1004 is threaded into the insert and applying force to the secondary shaft/tube or leg assemble 106.

Figure 11:
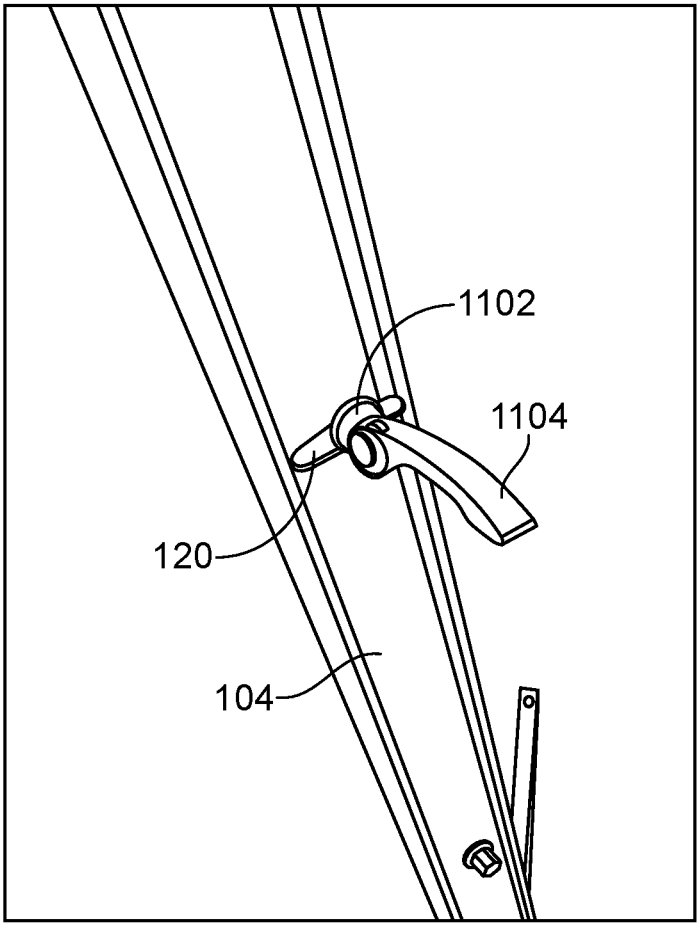
FIG. 11 illustrates the braking system in another embodiment of the present invention.

Referring to FIG. 11, the braking system 1102 in another embodiment is disclosed. In one embodiment, the braking system 1102 could be, but not limited to, a quick-release latch/lever 1104 and skewer (shown in FIG. 13) The braking system 1102 comprises a lever 1104 for enabling the user to lock or hold the secondary shaft 106 in place and stabilize the table base. The braking system 1102 is configured to enable the user to push down the lever 1104 for tightening the primary shaft 104 and the secondary shaft 106 at the bottom when the table 100 is self-stabilized on the uneven surfaces using and maintaining the bottom of the primary shaft 104 and secondary shaft 106 to control the movement or rotation. The braking system 1102, for example, a quick-release latch and skewer is secured to the primary shaft 104 via an aperture 120.

Figure 12:
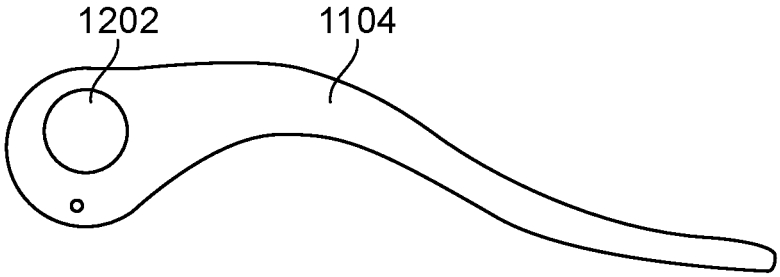
FIG. 12 illustrates a lever of the braking system in one embodiment of the present invention.

Referring to FIG. 12, the lever 1104 of the braking system 1102 is disclosed. In one embodiment, the lever 1104 comprises an opening or a hole 1202 for the insertion of a skewer. The user could push up and push down the lever 1104 of the braking system 1102 for tightening the primary shaft 104 and the secondary shaft 106 at the bottom when the table 100 is self-stabilized.

Figure 13:
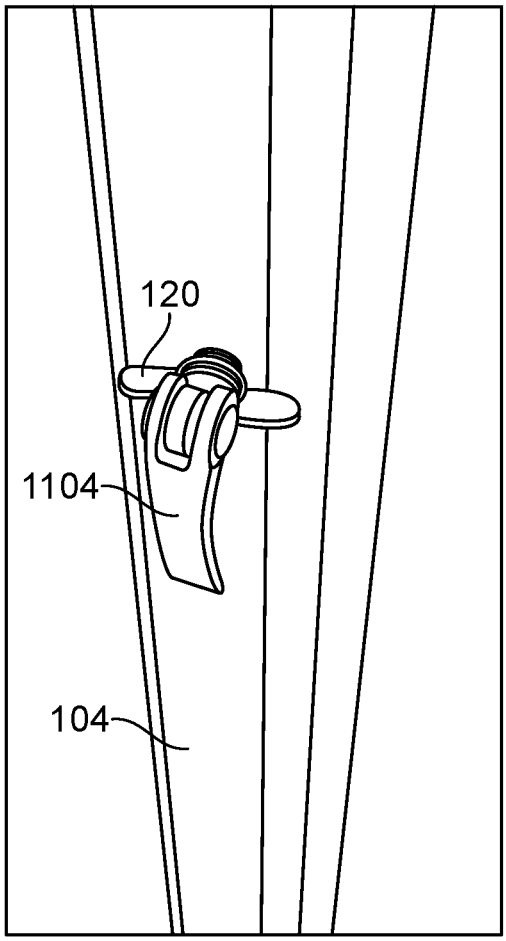
FIG. 13 illustrates the lever of the braking system in an engaged position in one embodiment of the present invention.

Referring to FIG. 13, the lever 1104 of the braking system 1102 in an engaged position is disclosed. In one embodiment, the user could push down the lever 1104 to engage or lock the secondary shaft 106 to the primary shaft 104, thereby maintaining the bottom of the primary shaft 104 and secondary shaft 106 to control the movement or rotation.

Figure 14:
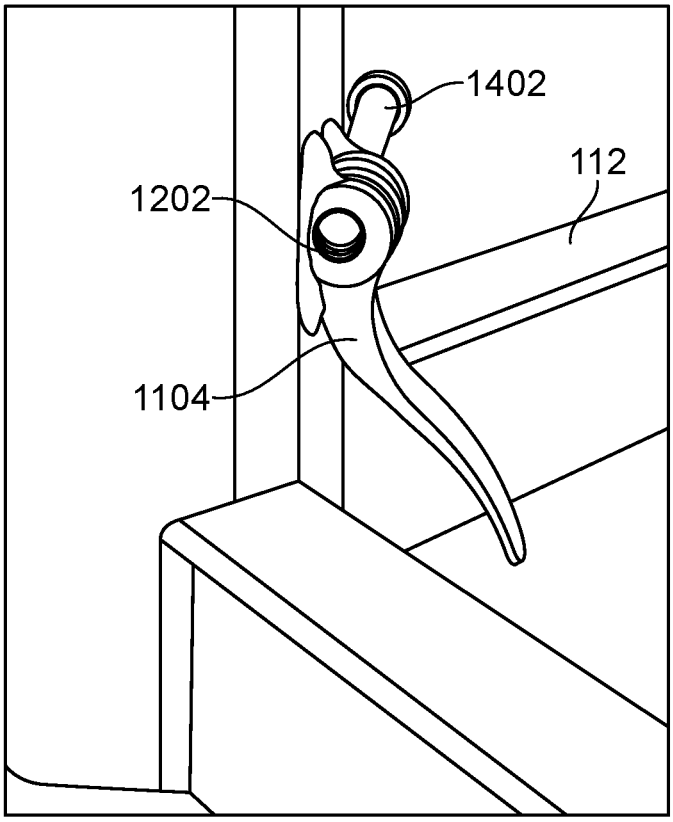
FIG. 14 illustrates the lever at the bottom portion in a locked position in one embodiment of the present invention.

Referring to FIG. 14, the lever 1104 mounted at the bottom portion in its locked position, according to one embodiment of the present invention. In one embodiment, the lever 1104 has a lever hole 1202 at one end. The lever hole 802 is aligned with the mating holes of the mating tabs molded on one of the legs 112, thereby allowing the insertion of the skewer 1402. In one embodiment, the leg 112 could be fixed leg. In one embodiment, the leg 112 could be two separate legs. In one embodiment, the skewer 1402 mounts the lever 1104 to the leg 112 at the bottom portion in a locked position. In one embodiment, the lever 1104 is activated between a locked position and a released position to stabilize the table base.

Figure 15:
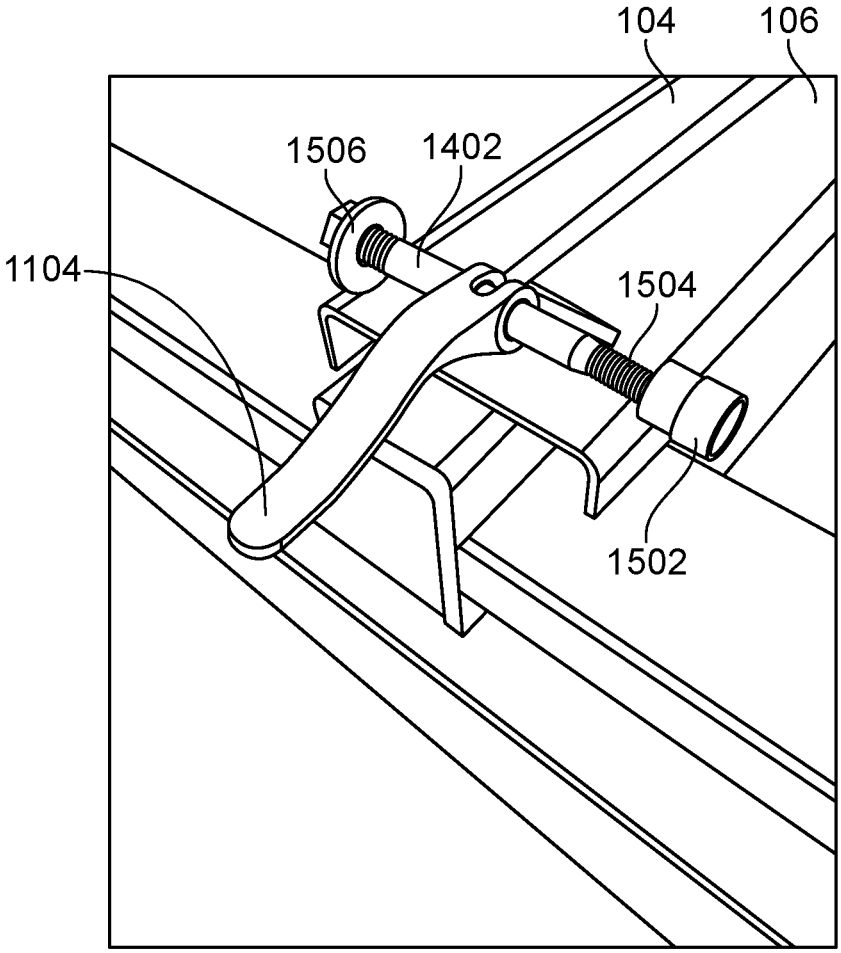
FIG. 15 illustrates an inner portion of the system to demonstrate the working of a latching mechanism in one embodiment of the present invention.

Referring to FIG. 15, an inner portion of the system to demonstrate the working of a latch mechanism or braking system, according to one embodiment of the present invention. In one embodiment, the latch mechanism uses an over-center brake concept for the table base. In one embodiment, the latch mechanism uses the skewer 1402 to lock the primary shaft 104 and the secondary shaft 106 in place. In one embodiment, the skewer 1402 is inserted via the brake aperture 120 at the bottom portion of the primary shaft 104 and the secondary shaft 106 to lock the shafts (104 and 106) in place. The skewer 1402 has a plurality of threads 1504 at both ends. In one embodiment, a lock nut 1502 is screwed at one end of the skewer 1402 via threads 1504. In one embodiment, a washer 1506 is positioned at the other end of the skewer 1402. The washer 1506 is used for mating the leg surface when tightened. In one embodiment, the latch mechanism moves up and down to tighten in a way the quick-release mechanism works.

Figure 16:
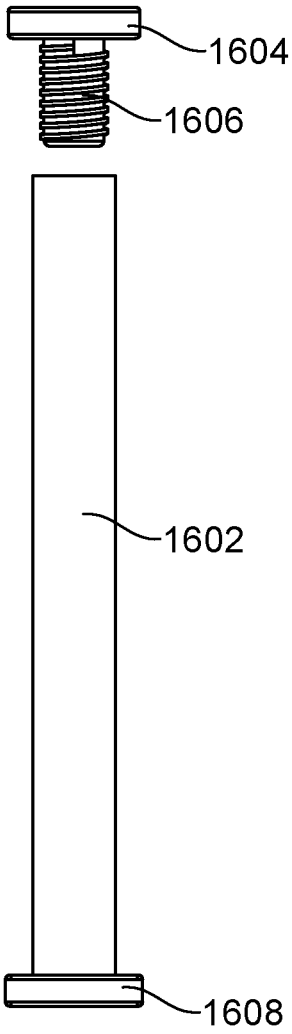
FIG. 16 illustrates a perspective view of the sex bolt assembly in one embodiment of the present invention.

Referring to FIGS. 16 and 17, different views of a sex bolt assembly or sex bolt or a stabilization assembly is provided according to one embodiment of the present invention. The sex bolt 1602, also known as barrel nut, barrel bolt, binding barrel, Chicago screw, post, and screw or connector bolt is a type of fastener and in this embodiment, acts as a pivot. In one embodiment, the sex bolt 1602 assists in keeping the table stabilized under weighted conditions. In one embodiment, the sex bolt 1602 is inserted via the stabilization mounting hole 118 in the primary shaft 104 and through the secondary shaft 106 via mounting aperture 119. The stabilization mounting hole 118 is fitted and dimensioned for the insertion of the sex bolt 1602. In one embodiment, the sex bolt 1602 is has a cap 1604 having a strut with a plurality of threads 1206 at its lower surface. The sex bolt 1602 has an open at its upper end configured to receive the threaded strut 1606 of the cap 1604. In one embodiment, the cap 1604 further has a hex divot or a slot 1702 on its upper surface. The hex divot 1702 is used for tightening and loosening of the cap 1604 into the open. In one embodiment, the sex bolt 1262 further has a fixed stop 1608 at its lower end.

Figure 18:
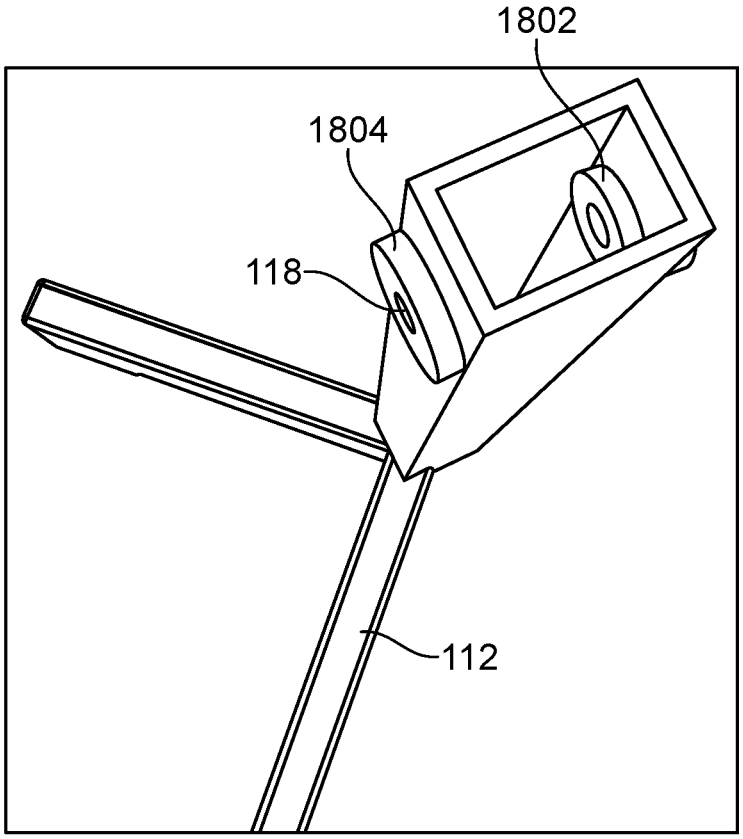
FIG. 18 illustrates the mounting of the bushings in one embodiment of the present invention.

Referring to FIG. 18, the mounting of one or more sex bolt bushings, according to one embodiment of the present invention. In one embodiment, the one or more sex bolt bushings include an inner bushing 1902 and an outer bushing 1804. In one embodiment, the bushings (1802 and 1804) are installed into the inner tube or secondary shaft 106 configured to provide even spacing between the outer tube or primary shaft 104 and secondary shaft 106. In one embodiment, the bushings (1802 and 1804) also provide smoother and more precise movement of the secondary shaft 106. In one embodiment, the bushings (1802 and 1804) hold the secondary shaft 106 spacing to reduce the clanging of the shafts (104 and 106). Further, the bushings (1802 and 1804) are made from a synthetic polymer. In one embodiment, the polymer is Polytetrafluoroethylene (PTFE) material.

Figure 19:
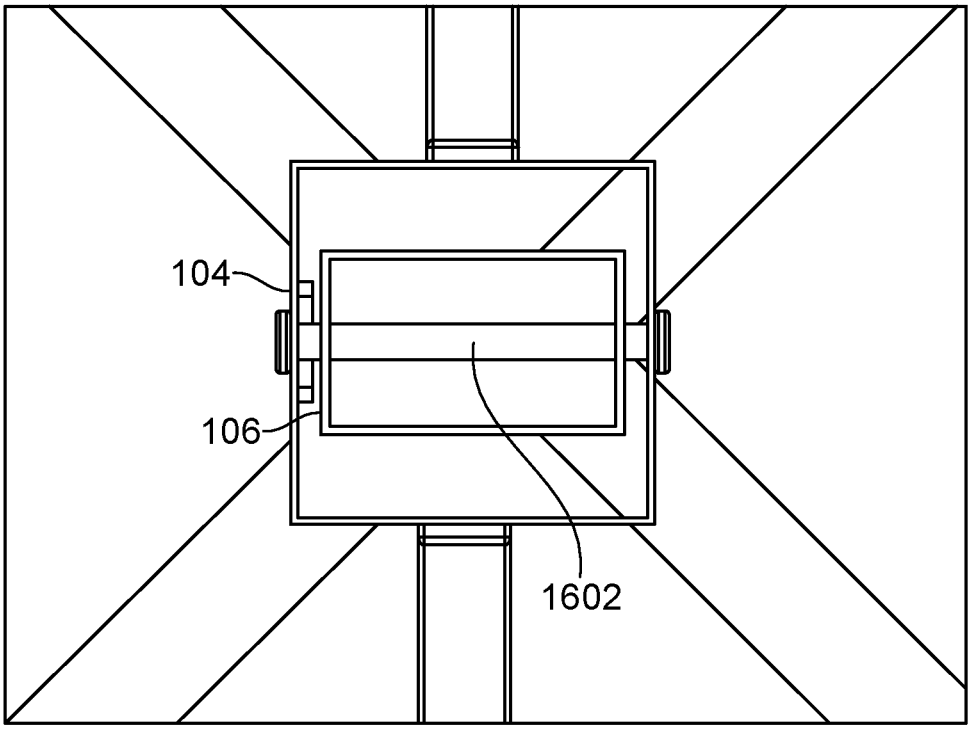
FIG. 19 illustrates a top internal view of the sex bolt assembly mounted between a primary shaft and a secondary shaft in one embodiment of the present invention.

Referring to FIG. 19, a top internal view of the sex bolt assembly 1602 mounted between the primary shaft 104 and the secondary shaft 106, according to one embodiment of the present invention. The sex bolt 1602 is a precision machined carbon steel bolt with internal threaded (female) end and an external threaded (male) clamping end. Each end has an internal "hex" socket. The internal threads and clamping end allow for the sex bolt 1602 to support a load and or shearing forces along its uniform diameter. When assembled, and tightened, the sex bolt 1602 maintains a specified distance between the clamping faces. In one embodiment, the sex bolt 1602 is inserted via the primary shaft 104 and secondary shaft 106. The sex bolt 1602 when used on the table base, affords a precise level of fit and clamping forces that allows the table base to rotate freely and maintain the stability required to stabilize the heavy tabletop on the uneven surface. The sex bolt 1602 affords a simple, precise, durable, robust method to precisely hold the secondary shaft 106 inside the primary shaft 104. When assembled and tightened, the sex bolt 1202 does not distort the surface of the primary shaft 104. This precision assemble allows the secondary shaft 106 to rotate freely within the primary shaft 104.

Figure 20:
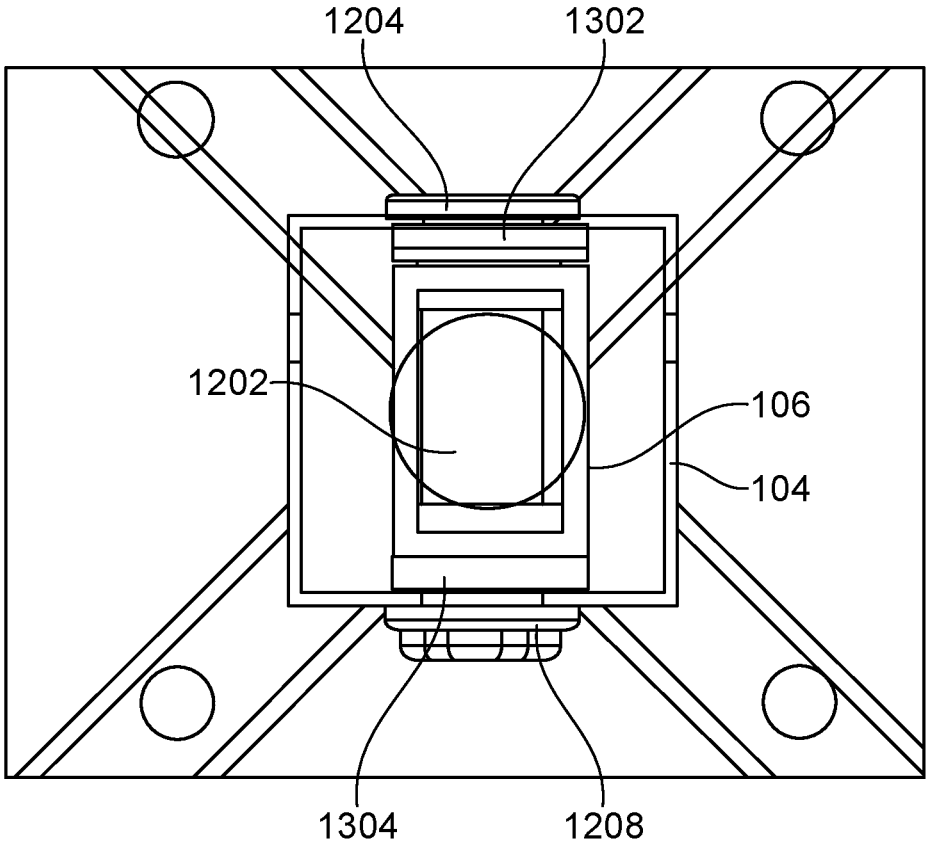
FIG. 20 illustrates a top internal view of the sex bolt assembly with busing mounted between a primary shaft and a secondary shaft in one embodiment of the present invention.

Referring to FIG. 20, a top internal view of the sex bolt assembly 1602 with bushing (1802 and 1804) mounted between the primary shaft 104 and the secondary shaft 106, according to one embodiment of the present invention. The sex bolt 1602 is inserted via the primary shaft 104 and secondary shaft 106. In one embodiment, the sex bolt 1602 is has a cap 1604 at one end and a fixed stop 1608 at another end. In one embodiment, the sex bolt further comprises one or more sex bolt bushings including the inner bushing 1802 at one end and the outer bushing 1804 at another end. In one embodiment, the bushings (1802 and 1804) are installed into the secondary shaft 106 configured to provide even spacing between the primary shaft 104 and secondary shaft 106. In one embodiment, the bushings (1802 and 1804) are configured to maintain a constant clearance for the primary shaft 104 and secondary shaft 106.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A table with a stabilizing system comprising:

a primary shaft having a bottom portion, a lower portion, and an upper portion, wherein the primary shaft has a cut-out at the bottom portion, a locking hole at the lower portion, and a stabilization mounting hole at the upper portion;

a secondary shaft inserted into the primary shaft that when inserted, is movably affixed to the primary shaft, wherein the secondary shaft has a bottom portion, a lower portion, and an upper portion, and wherein the secondary shaft has a locking hole at the lower portion, and a stabilization mounting hole at the upper portion;

a pivot positioned through the primary shaft stabilization mounting hole and the secondary shaft mounting hole to movably affix the secondary shaft to the primary shaft about a single point of movement;

a lock positioned through the primary shaft locking hole and the secondary shaft locking hole, wherein the lock fastens the secondary shaft to the primary shaft; and one or more support braces, wherein the one or more support braces are securely affixed to the primary shaft for supporting the tabletop.

2. The table of claim 1, wherein the lock comprises a brake knob threadedly secured to the primary shaft and the secondary shaft, wherein the brake knob enables a user to lock the primary shaft and the secondary shaft when the table settles on a surface so that the table does not rock.

3. The table of claim 2, wherein the brake knob allows a user to apply a variable force to the secondary shaft causing an increase in a coefficient of friction between the primary shaft and secondary shaft to lock the secondary shaft in place, stabilizing the table base, and wherein the knob enables the user to twist for tighten the primary shaft and the secondary shaft when the table is self-stabilized on an uneven surface.

4. The table of claim 1, wherein the lock comprises a quick-release latch and skewer, wherein the skewer is threadedly secured to the primary shaft and the secondary shaft, and the latch enables a user to lock the primary shaft and the secondary shaft when the table settles on a surface so that the table does not rock.

5. The table of claim 4, wherein the latch allows a user to apply a variable force to the secondary shaft causing an increase in a coefficient of friction between the primary shaft and secondary shaft to lock the secondary shaft in place, stabilizing the table and wherein the braking system enables the user to tighten the primary shaft and the secondary shaft when the table is self-stabilized on the uneven surface.

6. The table of claim 1, wherein the pivot comprises a sex bolt assembly, and wherein the sex bolt assembly comprises a barrel-shaped flange and protruding boss that is internally threaded.

7. The table of claim 1, further comprising one or more internal shims, wherein the one or more shims are securely mounted on the secondary shaft to provide cushioning to protect the primary and secondary shafts when being secured by the lock, and to further provide a barrier against table wobble.

8. The table of claim 1, further comprising a pair of legs perpendicularly affixed to the bottom portion of the secondary shaft, primary shaft, or both.

9. The table of claim 1, further comprising an additional fixed primary shaft having a pair of legs for supporting a long table, wherein the pair of legs are steadily and perpendicularly secured to the bottom portion of the additional fixed primary shaft.

* * * * *